US010081961B1

(12) United States Patent
Blomgren

(10) Patent No.: US 10,081,961 B1
(45) Date of Patent: Sep. 25, 2018

(54) METHOD AND APPARATUS TO CONTROL ROCKING OF MULTIPLE SHEAR WALL PANELS SUBJECT TO A LOADING EVENT

(71) Applicant: Katerra, Inc., Menlo Park, CA (US)

(72) Inventor: Hans-Erik Blomgren, Vashon, WA (US)

(73) Assignee: Katerra, Inc., Menlo Park, CA (US)

( * ) Notice: Subject to any disclaimer, the term of this patent is extended or adjusted under 35 U.S.C. 154(b) by 0 days.

(21) Appl. No.: 15/786,157

(22) Filed: Oct. 17, 2017

Related U.S. Application Data

(60) Provisional application No. 62/521,963, filed on Jun. 19, 2017.

(51) Int. Cl.

| | |
|---|---|
| ***E04H 9/02*** | (2006.01) |
| ***E04H 9/14*** | (2006.01) |
| ***E04B 1/26*** | (2006.01) |
| ***E04B 2/02*** | (2006.01) |

(52) U.S. Cl.
CPC ..... *E04H 9/027* (2013.01); *E04H 9/14* (2013.01); *E04B 2001/2696* (2013.01); *E04B 2002/0254* (2013.01)

(58) Field of Classification Search
CPC ... E04H 9/14; E04H 9/027; E04B 2002/0254; E04B 2001/2696
See application file for complete search history.

(56) References Cited

U.S. PATENT DOCUMENTS

| | | | | |
|---|---|---|---|---|
| 6,067,769 A * | 5/2000 | Hardy | E04C 3/02 | 52/295 |
| 7,506,479 B2 * | 3/2009 | Pryor | E04B 2/707 | 52/293.3 |
| 8,327,592 B2 * | 12/2012 | Lafferty, III | E04B 1/26 | 52/220.2 |
| 8,635,820 B2 * | 1/2014 | Lafferty, III | E04B 1/26 | 52/220.2 |
| 8,806,833 B2 * | 8/2014 | Lafferty, III | E06B 9/04 | 52/202 |
| 8,935,892 B2 * | 1/2015 | Buchanan | E04B 1/10 | 248/560 |

* cited by examiner

*Primary Examiner* — Andrew J Triggs
(74) *Attorney, Agent, or Firm* — Elliott, Ostrander & Preston, P.C.

(57) ABSTRACT

A building wall includes a first shear wall panel having a horizontal bottom edge and a right vertical edge, a horizontal base support located under the horizontal bottom edge of the first shear wall panel, and a first tie-down that couples the first shear wall panel to the base support at a central point along the horizontal bottom edge of the first shear wall panel such that the shear wall panel rocks under horizontal forces. The wall further includes a second shear wall panel in plane with and adjacent to the first shear wall panel, the second shear wall panel having a horizontal bottom edge and a left vertical edge. The horizontal base support further is located under the horizontal bottom edge of the second shear wall panel, and a second tie-down couples the second shear wall panel to the base support at a central point along the horizontal bottom edge of the second shear wall panel such that the second shear wall panel rocks under horizontal forces. A connector couples the first shear wall panel along a portion of its right vertical edge to the adjacent second shear wall panel along a portion of its left vertical edge.

16 Claims, 7 Drawing Sheets

600

METHOD AND APPARATUS TO CONTROL ROCKING OF MULTIPLE SHEAR WALL PANELS SUBJECT TO A LOADING EVENT

RELATED APPLICATIONS

This application claims the benefit of the filing date of U.S. provisional patent application No. 62/521,963, filed Jun. 19, 2017, entitled "Method and Apparatus for Minimizing Damage to a Shear Wall Panel Subject to a Loading Event", the entire contents of which are incorporated by reference under 37 C.F.R. § 1.57.

This application is related to U.S. patent application Ser. No. 15/786,141, filed concurrently herewith, entitled "Method and Apparatus to Minimize and Control Damage to a Shear Wall Panel Subject to a Loading Event", the entire contents of which are incorporated by reference under 37 C.F.R. § 1.57.

TECHNICAL FIELD

The invention relates to shear wall panel construction method and apparatus that provides protection against significant loading events such as seismic events or high wind loading events on a building.

BACKGROUND

In recent years there has been research and development of construction systems and methods for single or multistory buildings to enable such buildings to withstand earthquakes and high winds without significant structural damage. What is needed is building techniques and elements that improve the ability of buildings to withstand earthquakes and winds with minimal or no structural damage during frequent low intensity events yet allow for controlled damage at large building drifts for rare high intensity events.

BRIEF DESCRIPTION OF THE DRAWINGS

Embodiments are illustrated by way of example, and not by way of limitation, and can be more fully understood with reference to the following detailed description when considered in connection with the figures in which.

DETAILED DESCRIPTION

Figure 1:
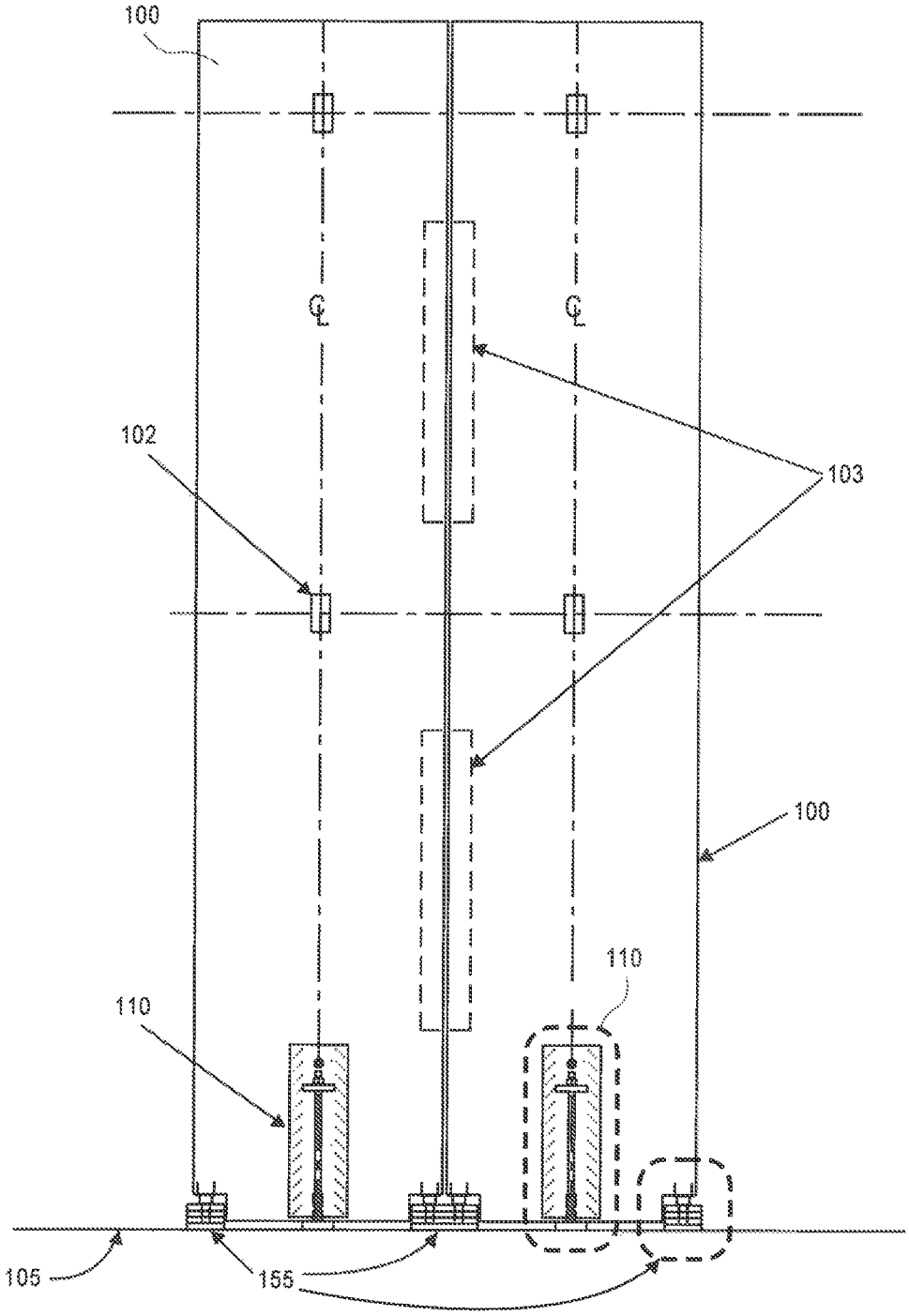
FIG. 1 illustrates two adjacent shear wall panels in accordance with an embodiment of the invention.
Figure 2:
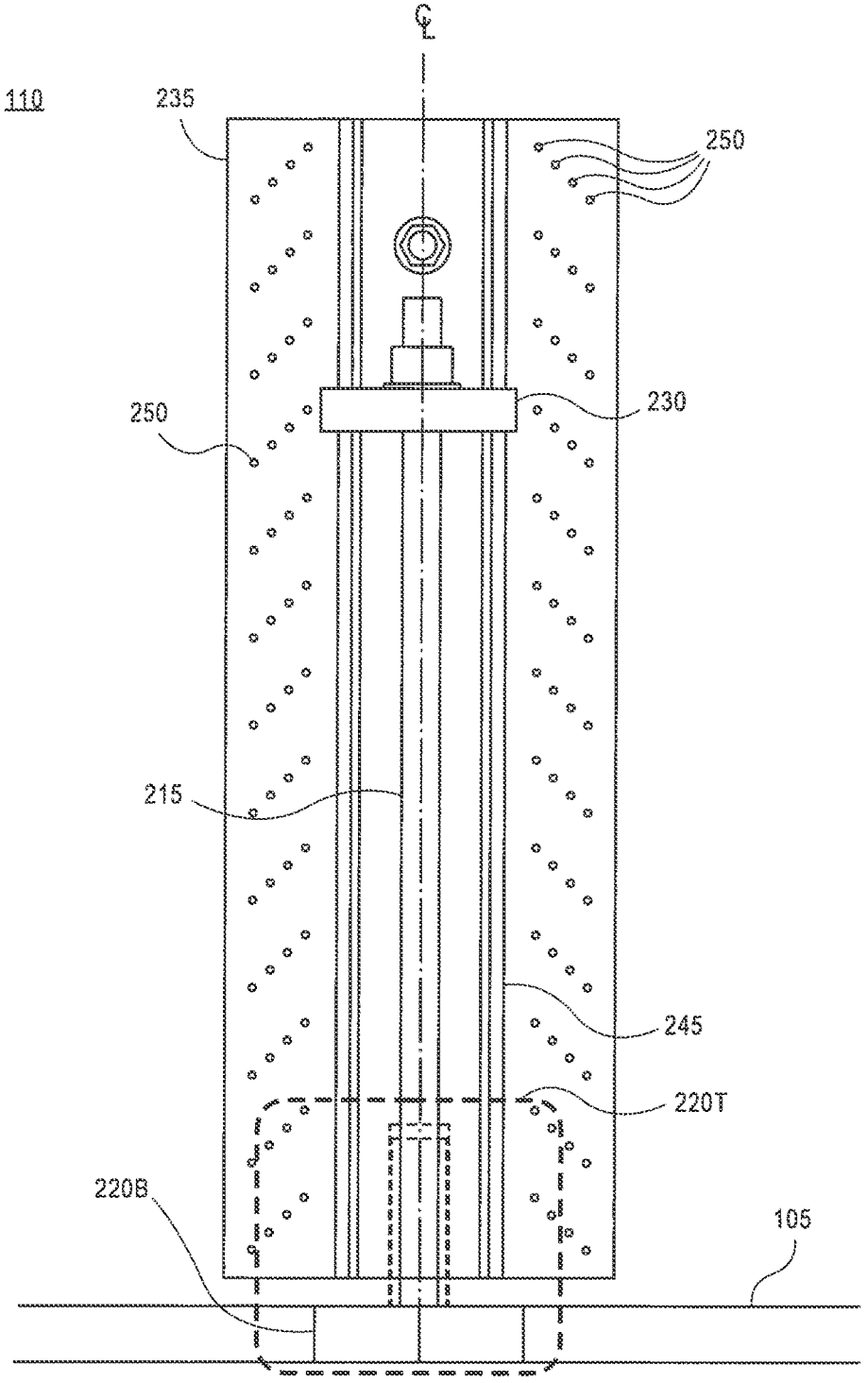
FIG. 2 illustrates a tie-down in accordance with an embodiment of the invention.
Figure 3A:
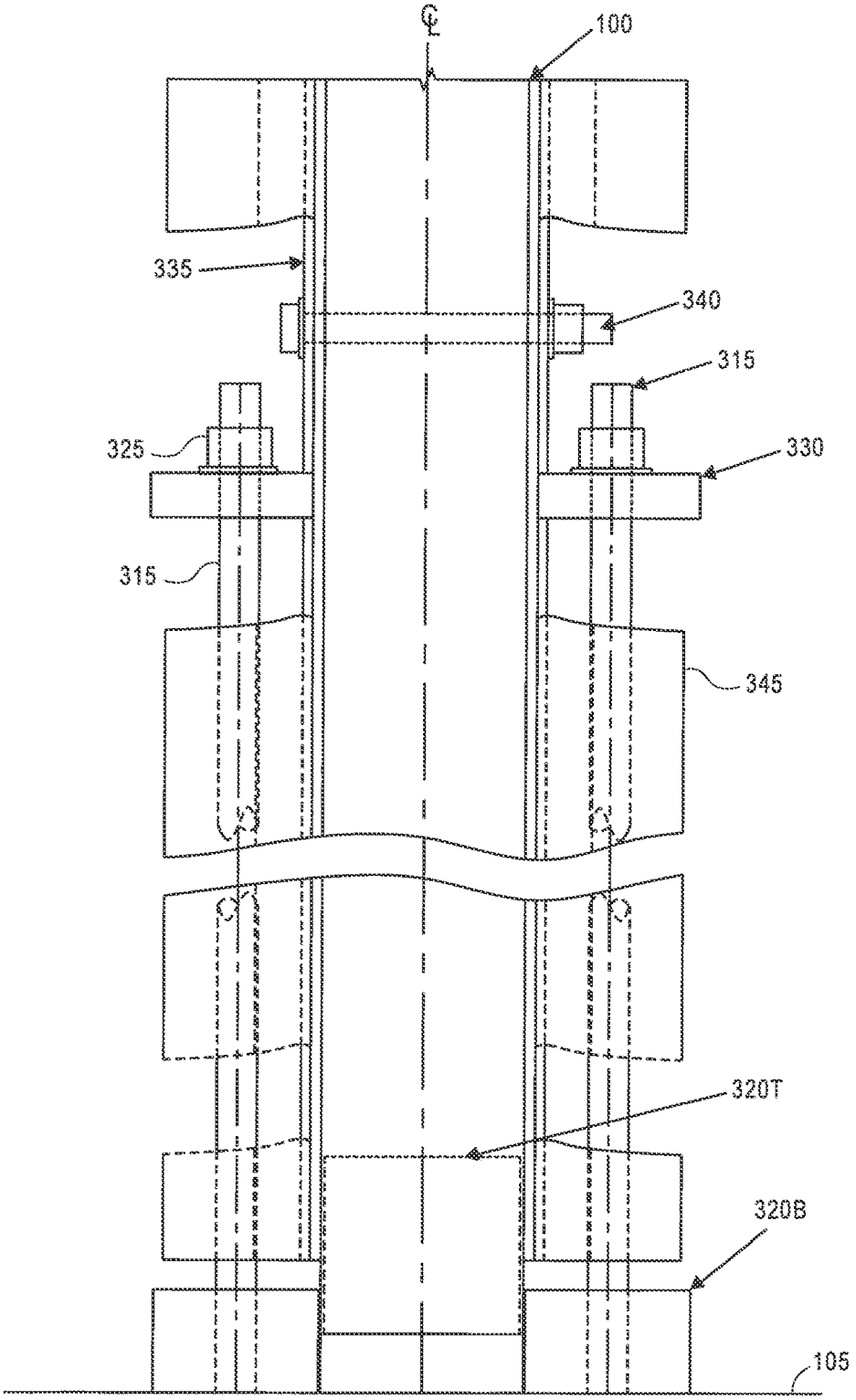
FIG. 3A illustrates an elevation view of a tie-down in accordance with an embodiment of the invention.
Figure 3B:
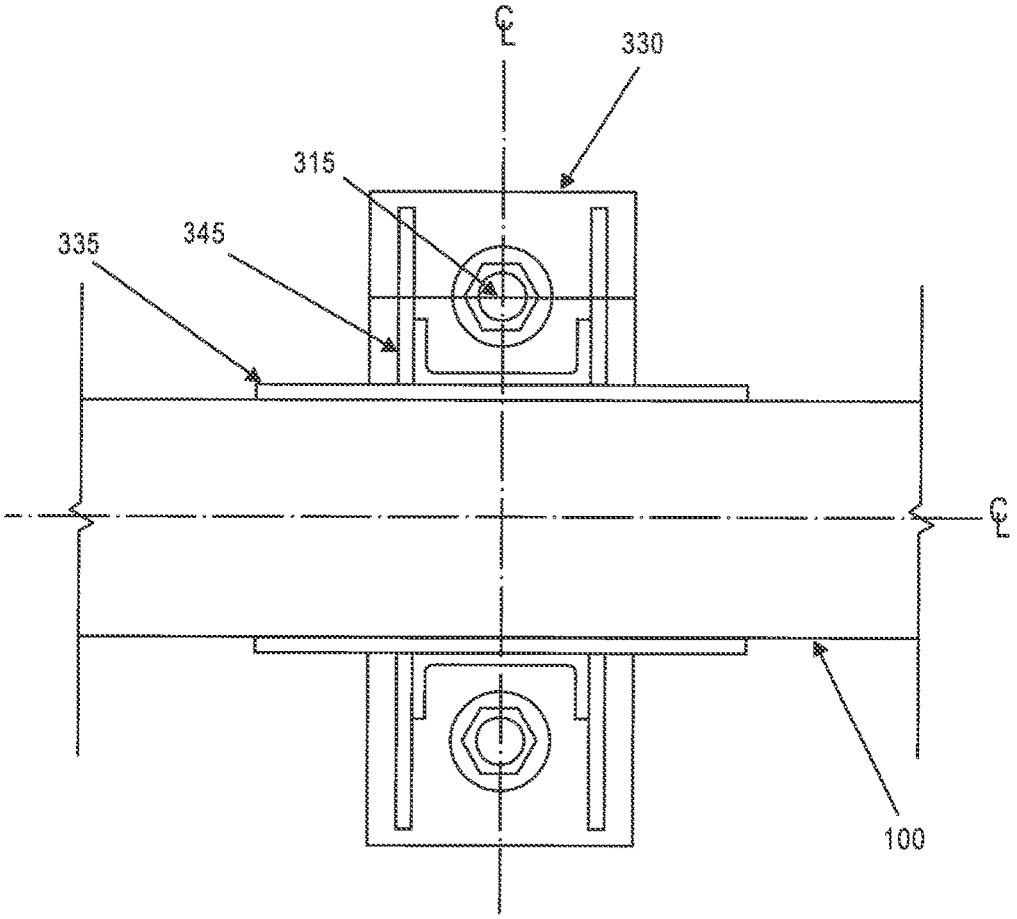
FIG. 3B illustrates a plan view of a tie-down in accordance with an embodiment of the invention.

FIG. 1 shows two adjacent shear wall panels 100. In one embodiment, the panels are mass timber panels, formed of, for example, cross-laminated timber (CLT). The shear wall panels 100 stand on a base support 105, e.g., a top edge of a lower story wall (such as a CLT panel), or a foundation, for example, a foundation wall, a ground level floor, or upper story floor. The shear wall panels 100 are each connected to the base support 105 by a respective tie-down 110. In one embodiment, the shear walls extend vertically one or more stories or levels. In the example illustrated in FIG. 1, the shear wall panels extend two levels, or stories, from base support 105, interconnecting with a floor at level 1 and another floor at level 2. Generally speaking, in one embodiment, the shear wall panels are rectangular, with dimensions greater in height than in width. Those skilled in the art recognize there are various well known means for interconnecting the shear wall panels to the floors. In the illustrated embodiment, the panels are interconnected with the floors at level 1 and level 2 via respective floor pin connectors 102. The floor pin connectors allow for controlled rocking of the shear wall panels about their base. In one embodiment, the shear wall panels 100 are centrally supported on base support 105 at the location of a tie-down 110. In other words, each shear wall panel 100 is coupled to the base support 105 by a tie-down 110, and the tie down is located equidistant from the left and right vertical edges of the shear panel. Essentially, the shear wall panel is balanced on the supporting tie-down. During a low intensity seismic or other loading event the adjacent shear wall panels can rock to one side or the other, and back again as a rigid unit, under the influence of an imposed cyclic lateral or horizontal force. During a high intensity seismic or other loading event the adjacent shear wall panels can rock to one side or the other, and back again in an independent manner, under the influence of lateral or horizontal force. In either case, shear panels rock from side to side about their point of attachment to the base support, that is, about their respective tie-downs to the base support. The independent wall rocking allows for motion dampening/energy dissipation at the inter-shear wall panel connectors and toe crushers, as discussed below.

In one embodiment, inter-shear wall panel connectors 103 are provided in between the longitudinal edges of adjacent shear wall panels 100. The connectors 103 are accessible from one or both sides of the shear wall panels so that they can be replaced after a seismic event or other loading event without requiring removal or replacement of the shear wall panels 100. During rocking motion, the inter-shear wall panel connectors 103 absorb energy, typically by deformation of the connectors or a functional part thereof. The connectors 103 damp motion (i.e., dissipate energy) between the shear wall panels. The connectors may be in any form which will absorb energy, typically through yielding of the connector or a functional component thereof. It is appreciated in other embodiments that the connectors may absorb energy by other means, such as friction, viscous damping action, crushing, or pounding action.

With reference to FIGS. 1, 2, 3A, and 3B a tie down 110 comprises a rod, bar, or cable 215, 315, etc., made of high tensile strength material, such as steel, and a base support anchor 220, 320, such as a base support plate, and a wall anchor 235, 325, such as a wall plate. In particular, the rod is fixed in or to the base support 105 by being anchored to the anchor 220, 320, such as a steel base support plate. Likewise, the tie-down 110 is fixed in or to a shear wall panel 100 by being anchored to the anchor 235, 335, such as a steel wall plate. In one embodiment, a single rod is fixed to the base support and the shear wall panel. In another embodiment, a second rod is fixed to the base support and opposite side of the shear wall panel, as illustrated in FIGS.

Figure 4A:
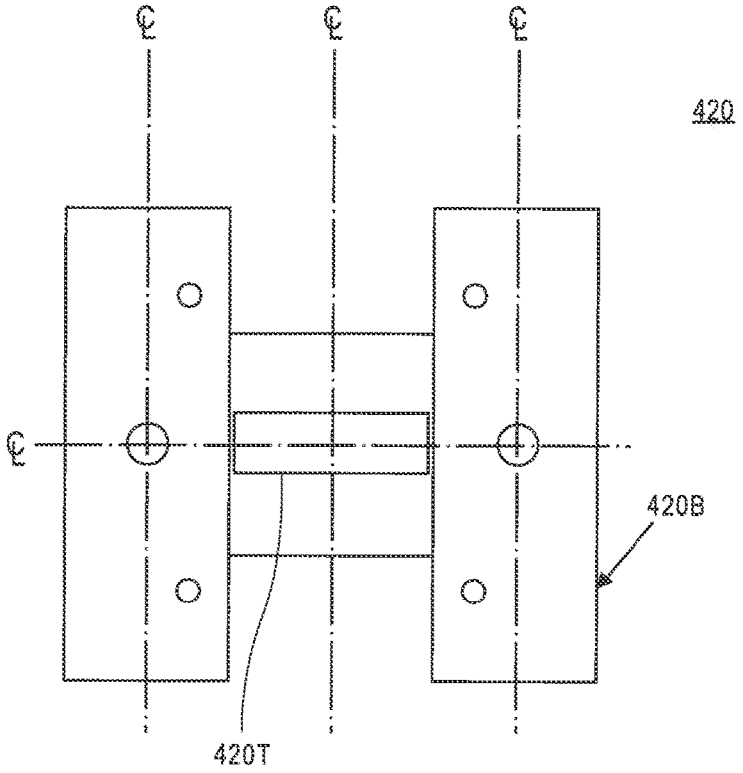
FIG. 4A illustrates a plan view of a shear wall panel supported by the anchor according to an embodiment of the invention.
Figure 4B:
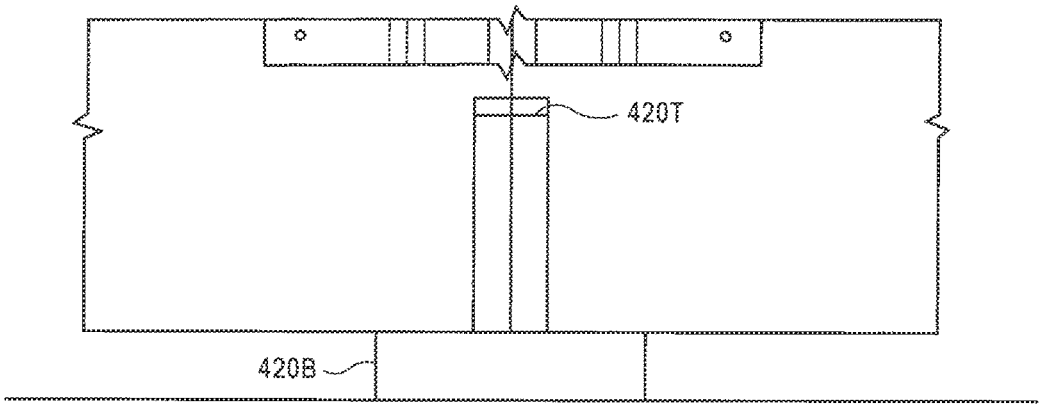
FIG. 4B illustrates an elevation view of a shear wall panel supported by the anchor according to an embodiment of the invention.

3A and 3B. In another embodiment, anchor 220, 320 is an inverted T-shaped anchor consisting of a flat plate or base plate 220B, 320B oriented in a horizontal plane, and a vertical plate 220T, 320T, sitting on top of and connected to the base plate and oriented in a vertical plane so that the vertical plate and base plate essentially form an inverted T-shaped anchor. In one embodiment, with further reference to FIGS. 4A and 4B, the shear wall panel supported by the anchor includes a slot into which all or a substantial portion of the vertical plate portion of the anchor is inserted when the shear wall panel is secured in place during construction of the building. In one embodiment, the vertical plate portion of the anchor and the corresponding slot in the shear wall panel are normal to the plane of the shear wall panel. In one embodiment, the dimensions of the slot are sufficiently larger than the dimensions of the vertical plate, for example, to allow for controlled rocking of the shear wall panel.

In one embodiment, a threaded end of the rod 215, 315 may be threaded through anchor 220, 320, e.g., a steel plate. In other embodiments, the rod may be welded to anchor 220, 320, or the threaded end passed through and secured with a nut on the other side of the steel plate. In one embodiment, the other threaded end of rod 215, 315 may pass through angle or block 230, 330 and be secured with a nut 325 on the other side of angle or block 230, 330. This enables the force applied by the rod to the shear wall panel to be adjusted at various times or intervals, or before/after loading events, during the life of the building. Block/angle 230, 330, in turn, is fixed to shear wall panel 100 by being anchored to anchor 235, 335, e.g., a steel wall plate. In one embodiment, a threaded bolt may pass through block/angle 230, 330, steel wall plate 235, 335, and the shear wall panel 100 and be secured with a nut 340 on the other side of shear wall panel 100. In one embodiment, steel wall plate 235, 335 is secured to shear wall panel 100 via fastening means, e.g., metal fasteners such as nails, screws, or bolts 250, and/or adhesives.

Importantly, the tie-downs 100 are not fixed to the shear wall panels 100 along the length or width of the panels. Rather the tie-downs are fixed to shear wall panels 100 only where rod element 215, 315 is secured to anchor 235, 335 by way of being secured to block or angle 230, 330, which in turn is secured to the shear wall panel 100. This configuration allows for each independent shear wall panel to move, e.g., rock or rotate, with respect to the base support 105, as may happen during a loading event, such as when earthquake or seismic activity occurs. In one embodiment, all or a substantial portion of rod element 215, 315 is oriented along a longitudinal axis of a stiffened steel plate element such as a structural steel channel 245, 345. In one embodiment, the channel 245, 345 is of sufficient cross sectional area to provide for the rod element 215, 315 to move or deform within the cross-sectional area of the opening in structural channel 245, 345. It is appreciated that various dimensions of structural channel or structural steel section material may be used in different embodiments, depending on various factors such as the placement of anchor 235, 335, the length of rod element 215, 315, etc. In one embodiment, the rod element 215, 315 may be concealed and substantially centered within the thickness of the mass timber panel, for architectural and/or aesthetic considerations, or when external rod elements would otherwise not fit within a wall cavity or external building envelope.

Figure 5A:
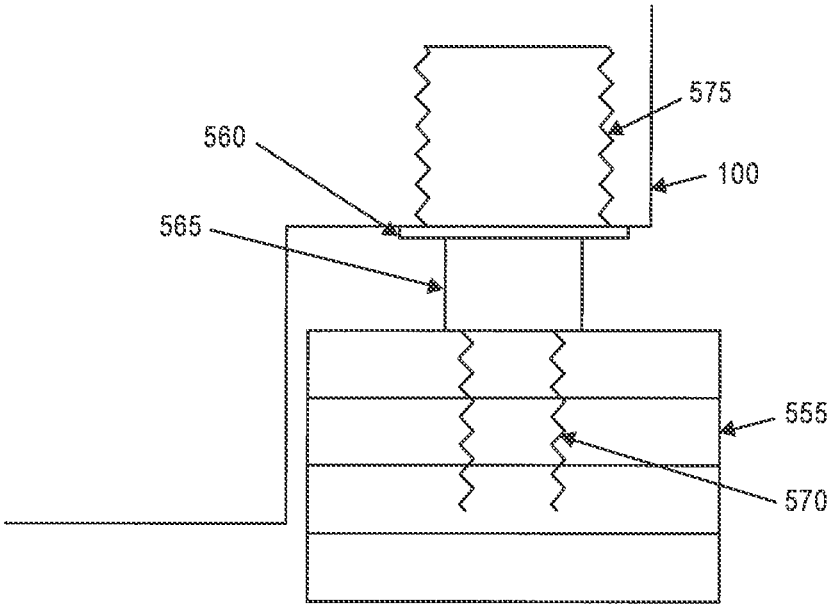
FIG. 5A illustrates an elevation view of a "toe crusher" in accordance with an embodiment of the invention.
Figure 5B:
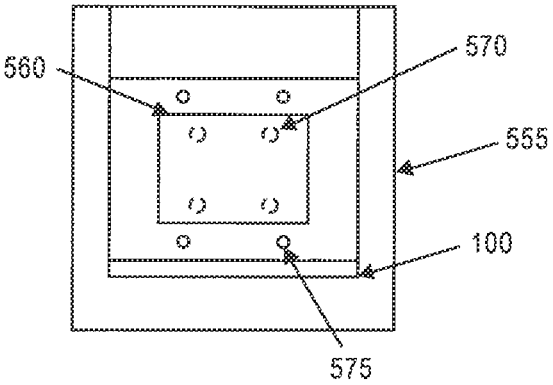
FIG. 5B illustrates a cross sectional view of the "toe crusher" in accordance with an embodiment of the invention.

With reference to FIGS. 1, 5A and 5B, each shear wall panel is supported at or near its bottom corners by a toe crushing element, or toe crusher, or simply, "toe", 155, 555. While the shear wall panel corners depicted in FIGS. 1, 5A and 5B are cut out to accommodate the toes, in another embodiment, the corners are not cut out—the bottom edge of the shear wall panel forms a straight line, and the bottom edge of the shear wall panel rests on the top of the toes; no part of the shear wall panel in such an embodiment extends substantially below the top of the toes. In such case, the gap formed between the bottom edge of the shear wall panel and base support 105, as well as toes 155, may be hidden or covered up with a building material, such as drywall affixed to a side surface of the shear wall panel and extending below the bottom edge of the shear wall panel, and/or a baseboard or the like. These toes, comprising blocks or layers of material in various embodiments—are provided between the bottom edge of the shear wall panels 100 and the base support 105. Under low loading events, the toes maintain or return to their original shape and condition when subjected to concentrated compression loads from the panel. Under sufficiently large loading events, the toes are permanently damaged, forming a gap between the toe and the respective bottom corner of the shear wall panel. Subsequent cyclic loading from the wall provide increasing compression damage and additional energy is absorbed by the pounding action that occurs due to the formed gap opening. Additionally, the damaged state at the toes softens the stiffness of the structure and thus increases the building period during the seismic event. This effect can reduce the seismic demands on the wall over the time of the event by shifting the building period out away from the periods (frequency content) of the ground motions that contain the most energy input. As the gap forms overall structural stability of the wall system is maintained by having a minimum of two adjacent wall panels interconnected at their abutted edge via one or more inter-panel connectors 103 and engaging a corresponding minimum of two adjacent tie downs 110. Advantageously, the bottom corners of the shear wall panels are not damaged—the toes are designed take the brunt of the damage and thereby prevent damage to and the need to remove and replace the shear wall panels. In one embodiment, the toes are also made readily or at least relatively accessible so that they can be replaced after a damaging loading event, such as a significant earthquake, without major demolition and reconstruction effort to the shear wall panels or other parts of the building. During the rocking motion that may occur during a loading event such as an earthquake, the toes 155, 555 absorb energy, typically by permanent deformation (e.g., crushing) of the toes or a functional part thereof. The toes damp motion (i.e., dissipate energy) between the shear wall panels 100 and the base support 105. The tie-downs 110 tie the shear wall panels 100 in place but allow the rocking motion to occur during a loading event of sufficient magnitude. After the loading event the toes 155, 555 may be replaced if necessary, without damage to or requiring removal or replacement of the panels 100.

The toes 155, 555 in FIGS. 1, 5A and 5B are fixed between the bottom corners of the shear wall panels 100 and the base support 105, and may, for example, be made of materials and components which will yield in compression or in both tension and compression, during rocking motion of the shear wall panels, and then return to their original condition, under low loading events. Under large loading events, the toes are permanently damaged, forming a gap between the shear wall panels and the toes. In the event the toes are damaged, they are made accessible so that they can be inspected and replaced if necessary after a damaging loading event.

In one embodiment, there is a platen, e.g., steel post 565, or other element or device, situated between the bottom corner of the shear wall panel and the toe that punches into and bears onto the rest of the toe where localized crushing/damage occurs.

Figure 6:
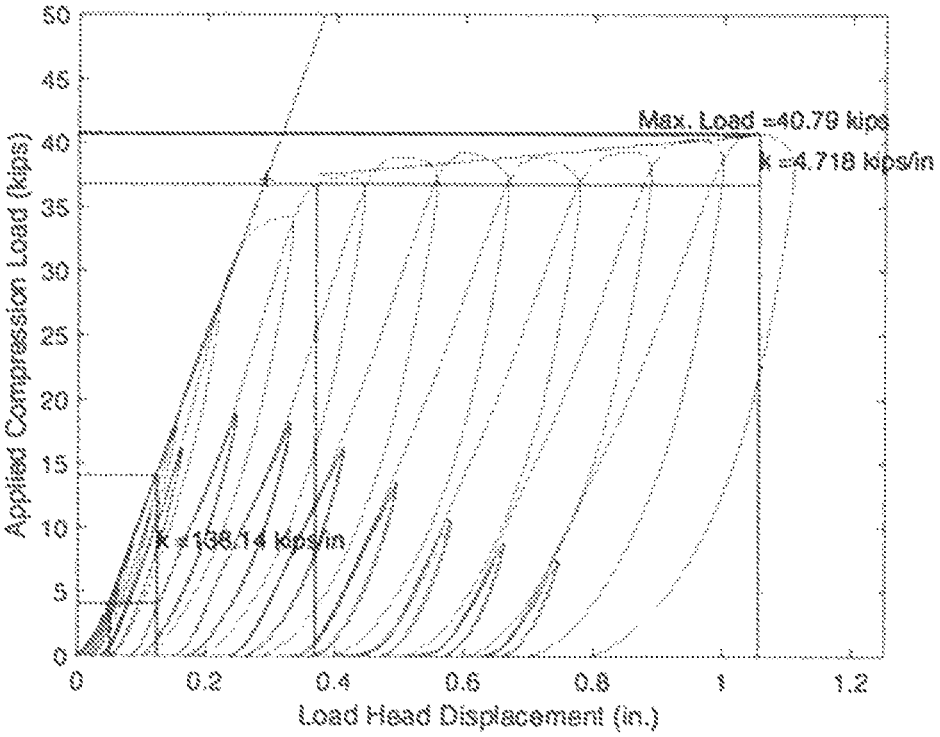
FIG. 6 illustrates a load deformation curve according to an embodiment of the invention.

In the embodiment illustrated in FIGS. 5A and 5B, a toe comprises one or more layers, for example, a multilayer wood block. In a preferred embodiment, the toe further comprises one or more reinforcing compression screws 570. Compression screws, in their conventional use, provide compression reinforcement perpendicular to the grain of the wood. One conventional use is in a wood beam or plate that supports an incoming beam that bears on top. The compression capacity is increased due to the screws. In this embodiment, the screws are used similarly. They install into the toe perpendicular to grain direction of the wood in the toe under the steel platen. They increase the compression capacity of the wood and also exhibit a desirable connection behavior beyond the proportional limit. See, for example, the load deformation curve 600 in FIG. 6 from an actual component level test. In one embodiment, the screws are located (e.g., centered) under post 565, so that as the post punches into the toe during a damaging loading event, the screws are driven further down into the toe with the localized block of wood directly under the steel post. As the screws are driven into the wood, they help maintain a near constant (flat) compression load up to large deformations. Multiple layers of the toe may be secured to each other via various means, such as adhesives, nails, screws (570 or otherwise) or bolts, or combinations thereof. The direction of the grain or orientation of the individual layers of wood may be in substantially the same or different directions with respect to each other, according to embodiments. The toe need not be secured to either the base support or the shear wall panel. In one embodiment, the toe may be secured to the base support, or to the shear wall panel, via various means, such as adhesives, nails, screws or bolts, or combinations thereof, but typically not both at the same time, so that the shear wall panel is allowed to rock about the centered tie-down 105, under the influence of lateral or horizontal force, such as during a high intensity seismic or other loading event, which allows for motion dampening/energy dissipation at the inter-shear wall panel connectors and toe crushers.

In one embodiment, the toe is positioned, and optionally connected to, the bottom cut-out corner of a shear wall panel. In one embodiment, a platen, e.g., steel post 565, is positioned between the top of the toe and the bottom of the shear wall panel. In one embodiment, the post generally has a curvilinear geometric shape, such as the shape of a cylinder or substantially cylindrical column. In another embodiment the post is oval shaped, or square or rectangular shaped. In one embodiment, the cross-sectional area or diameter of the post may be consistent along its vertical axis or taper between the top and bottom of the post, or there between. The cross-sectional area of the foot, or bottom, of the post may be equal to or less than the cross-sectional area of the surface of the toe on which the post sits, in one embodiment. In one embodiment, a steel plate 560 is positioned between the top of the post and the bottom cut-out corner of the shear wall panel. The plate may be secured via fastening means (e.g., wood screws 575) to the shear wall panel. Likewise the plate may be secured via fastening means to the post. The plate may comprise, in one embodiment, a flange, rim, or collar, of a shape with inside dimensions at least equal to or greater than a shape and outside dimensions of the corresponding respective end of the post that abuts the plate. The flange helps position the post under the sheer wall panel during installation, and during loading events. In one embodiment, a plate or shim may be positioned between the bottom of the toe and the upper surface of the base support In another embodiment (not illustrated), steel post 565 is positioned between the bottom of toe 555 and base support 105. In this embodiment too, the post generally has a curvilinear geometric shape, such as the shape of a cylinder or substantially cylindrical column. In another embodiment the post is oval shaped, or square or rectangular shaped. In one embodiment, the cross-sectional area or diameter of the post may be consistent along its longitudinal axis or taper between the top and bottom of the post, or there between. The cross-sectional area of the top of the post may be equal to or less than the cross-sectional area of the bottom of the toe, in one embodiment. In one embodiment, the steel plate 560 is positioned between the top of the post and the bottom of the toe. The plate may be secured via fastening means to one or both of the toe and the post. The plate may comprise, in one embodiment, a flange, rim, or collar, of a shape with inside dimensions at least equal to or greater than a shape and outside dimensions of the corresponding respective end of the post that abuts the plate. The flange helps position the post under the toe during installation, and during loading events. In one embodiment, a plate or shim may be positioned between the bottom of the post and the bases support.

Although embodiments of the invention have been described and illustrated in the foregoing illustrative embodiments, it is understood that present disclosure has been made only by way of example, and that numerous changes in the details of implementation of the invention can be made without departing from the spirit and scope of embodiments of the invention, which is only limited by the claims that follow. Features of the disclosed embodiments can be combined and rearranged in various ways.

What is claimed is:

1. A building wall, comprising:

a first shear wall panel having a horizontal bottom edge, a right vertical edge, a left vertical edge, a bottom left corner at an origin of the horizontal bottom edge and left vertical edge, and a bottom right corner at an origin of the horizontal bottom edge and right vertical edge;

a horizontal base support located under the horizontal bottom edge of the first shear wall panel;

a first tie-down coupling the first shear wall panel to the base support at a central point along the horizontal bottom edge of the first shear wall panel such that the shear wall panel rocks under horizontal forces;

a left "toe crushing element" situated under the bottom left corner of the first shear wall panel and a right "toe crushing element" situated under the bottom right corner of the first shear wall panel, the bottom left and right corners of the first shear wall panel compressing the respective left and right "toe crushing elements" as the first shear wall panel rocks under horizontal forces;

a second shear wall panel in plane with and adjacent to the first shear wall panel, the second shear wall panel having a horizontal bottom edge and a left vertical edge;

wherein the horizontal base support further is located under the horizontal bottom edge of the second shear wall panel;

a second tie-down coupling the second shear wall panel to the base support at a central point along the horizontal bottom edge of the second shear wall panel such that the second shear wall panel rocks under horizontal forces; and a connector coupling the first shear wall panel along a portion of its right vertical edge to the adjacent second shear wall panel along a portion of its left vertical edge.

2. The building wall of claim 1, wherein the bottom left and right corners of the first shear wall panel compress the respective left and right "toe crushing elements" as the first shear wall panel rocks under horizontal forces without causing permanent deformation to the left and right "toe crushing elements".

3. The building wall of claim 1, wherein the bottom left and right corners of the first shear wall panel compress the respective left and right "toe crushing elements" as the first shear wall panel rocks under horizontal forces causing permanent deformation to the left and right "toe crushing elements".

4. The building wall of claim 3, wherein the bottom left and right corners of the first shear wall panel compress the respective left and right as the first shear wall panel rocks under horizontal forces without causing permanent deformation to the left and right corners of the first shear wall panel.

5. The building wall of claim 1, wherein the left "toe crushing element" situated under the bottom left corner of the first shear wall panel and a right "toe crushing element" situated under the bottom right corner of the first shear wall panel are fastened to the respective bottom left and right corner of the first shear wall panel.

6. The building wall of claim 5, wherein the bottom left and right corners of the first shear wall panel tensioning the respective left and right "toe crushing elements" as the first shear wall panel rocks under horizontal forces.

7. The building wall of claim 1, further comprising a left steel post situated between the bottom left corner of the first shear wall and the left "toe crushing element" and a right steel post situated between the bottom right corner of the first shear wall and the right "toe crushing element".

8. The building wall of claim 7, wherein the bottom left and right corners of the first shear wall panel compressing the respective left and right "toe crushing elements" as the first shear wall panel rocks under horizontal forces comprises the bottom left and right corners of the first shear wall panel compressing the respective left and right steel posts into the respective left and right "toe crushing elements" as the first shear wall panel rocks under horizontal forces.

9. The building wall of claim 8, wherein the left and right "toe crushing elements" each comprise a plurality of horizontal layers of wood material and a reinforcing compressive screw positioned under the respective left and right steel posts and screwed vertically through at least a top layer of the plurality of horizontal layers of wood material.

10. The building wall of claim 9, wherein the bottom left and right corners of the first shear wall panel compressing the respective left and right steel posts into the respective left and right "toe crushing elements" as the first shear wall panel rocks under horizontal forces comprises the respective left and right steel posts driving vertically downward the reinforcing compressive screw further into the plurality of horizontal layers of wood material as the first shear wall panel rocks under horizontal forces.

11. The building wall of claim 1, wherein the bottom left corner and the bottom right corner of the first shear wall panel each comprises a cut-out section to accommodate the left "toe crushing element" situated under the bottom left corner of the first shear wall panel and the right "toe crushing element" situated under the bottom right corner of the first shear wall panel.

12. The building wall of claim 1, further comprising a left steel post situated between the base support and the left "toe crushing element" and a right steel post situated between the base support and the right "toe crushing element".

13. The building wall of claim 12, wherein the bottom left and right corners of the first shear wall panel compressing the respective left and right "toe crushing elements" as the first shear wall panel rocks under horizontal forces comprises the bottom left and right corners of the first shear wall panel compressing the respective left and right steel posts into the respective left and right "toe crushing elements" as the first shear wall panel rocks under horizontal forces.

14. The building wall of claim 13, wherein the left and right "toe crushing elements" each comprise a plurality of horizontal layers of wood material and a reinforcing compressive screw positioned above the respective left and right steel posts and screwed vertically through at least a bottom layer of the plurality of horizontal layers of wood material.

15. The building wall of claim 14, wherein the bottom left and right corners of the first shear wall panel compressing the respective left and right steel posts into the respective left and right "toe crushing elements" as the first shear wall panel rocks under horizontal forces comprises the respective left and right steel posts driving vertically upward the reinforcing compressive screw further into the plurality of horizontal layers of wood material as the first shear wall panel rocks under horizontal forces.

16. The building wall of claim 1, wherein the second shear wall panel further has a right vertical edge, a bottom left corner at an origin of the horizontal bottom edge and left vertical edge, and a bottom right corner at an origin of the horizontal bottom edge and right vertical edge; and a second left "toe crushing element" situated under the bottom left corner of the second shear wall panel and a second right "toe crushing element" situated under the bottom right corner of the second shear wall panel, the bottom left and right corners of the second shear wall panel compressing the respective second left and right "toe crushing elements" as the second shear wall panel rocks under horizontal forces.

* * * * *